US009103334B2

(12) United States Patent
Kotsiopoulos

(10) Patent No.: US 9,103,334 B2
(45) Date of Patent: Aug. 11, 2015

(54) AIR COMPRESSOR AND PISTON FOR AIR COMPRESSOR

(75) Inventor: Thomas Kotsiopoulos, Sierra Vista, AZ (US)

(73) Assignee: Thomas Kotsiopoulos, Sierra Vista, AZ (US)

( * ) Notice: Subject to any disclaimer, the term of this patent is extended or adjusted under 35 U.S.C. 154(b) by 910 days.

(21) Appl. No.: 13/324,487

(22) Filed: Dec. 13, 2011

(65) Prior Publication Data

US 2012/0207629 A1 Aug. 16, 2012

Related U.S. Application Data

(60) Provisional application No. 61/441,909, filed on Feb. 11, 2011.

(51) Int. Cl.

| | |
|---|---|
| ***F04B 17/03*** | (2006.01) |
| ***F16J 10/04*** | (2006.01) |
| ***F04B 35/04*** | (2006.01) |
| ***F04B 11/00*** | (2006.01) |
| ***F04B 53/16*** | (2006.01) |

(52) U.S. Cl.

CPC ..... *F04B 35/04* (2013.01); *F04B 11/0075* (2013.01); *F04B 53/166* (2013.01)

(58) Field of Classification Search

CPC ..... F04B 11/0075; F04B 35/04; F04B 53/166
USPC ..... 92/73, 140, 163, 170.1; 417/62, 415
See application file for complete search history.

(56) References Cited

U.S. PATENT DOCUMENTS

| | | | | |
|---|---|---|---|---|
| 3,266,383 | A * | 8/1966 | Cairns | 92/170.1 |
| 5,151,015 | A * | 9/1992 | Bauer et al. | 92/140 |
| 7,837,447 | B2 * | 11/2010 | Mao et al. | 417/415 |
| 8,414,535 | B2 * | 4/2013 | Jacobsen et al. | 92/140 |

* cited by examiner

*Primary Examiner* — Michael Leslie
(74) *Attorney, Agent, or Firm* — Leydig, Voit & Mayer, Ltd.

(57) ABSTRACT

An air compressor that can take in air at a particular pressure at the input and compress the air such that it exits an output at a much greater pressure until a desired pressure is reached in a piston assembly, at which point, the air compressor can shut off automatically by moving a switch. A tank does not need to be part of the compressor assembly, and thus, the air compressor is capable of determining the pressure and shutting off at the desired pressure regardless of the particular tank that is removeably connected to the air compressor. The switch can be moved to an off position by an arm pivotally connected to a carriage. In addition, the air compressor can utilize a piston assembly having a plurality of stationary o-rings for receiving a piston.

19 Claims, 12 Drawing Sheets

AIR COMPRESSOR AND PISTON FOR AIR COMPRESSOR

CROSS-REFERENCE TO RELATED APPLICATION

This patent application claims the benefit of U.S. Provisional Patent Application No. 60/441,909, filed Feb. 11, 2011, which is incorporated by reference in its entirety herein.

BACKGROUND

Air compressors are known in the art for supplying a flow of pressurized air for a variety of applications. They often use a motor that repetitively drives a piston to compress the air. As the air is compressed, it is often provided to and stored in a tank from which it can then be dispensed. The tank is typically brought up to a particular pressure by the compressor, at which point, a pressure sensor provides a signal that shuts off the motor. When the pressure in the tank drops to a particular pressure, as sensed by the pressure switch, or the compressor is manually turned on again, the motor will turn back on to continue the flow of pressurized air to the tank.

Typical consumer air compressors provide air pressures of about 200 psi or lower. Some applications, however, may require pressures greatly exceeding 200 psi. For example, paintball guns often have tanks that are filled to very high pressures such as 3000 psi-4500 psi. Similarly, scuba tanks are also filled to very high pressures. Thus, most consumer air compressors are not suitable for high pressure applications.

Furthermore, piston assemblies used for common air compressors utilize an interference fit of metallic sealing ring that is attached to and moves with the piston. Due to the number of cycles that the piston is required to undergo during operation, piston failure, and thus compressor failure, is often attributed to wear experienced by the piston components.

BRIEF SUMMARY

An air compressor is disclosed that can take in air at a particular pressure at the input and compress the air such that it exits an output at a much greater pressure until a desired pressure is reached in a piston assembly, at which point, the air compressor can shut off automatically by moving a switch. A tank does not need to be part of the compressor assembly, and thus, the air compressor is capable of determining the pressure and shutting off at the desired pressure regardless of the particular tank that is removeably connected to the air compressor. The switch can be moved to an off position by an arm pivotally connected to a carriage, and thus, an electronic pressure sensor is not required. The air compressor is relatively inexpensive to manufacture, durable, and easy to maintain. In addition, the air compressor can utilize a piston assembly having a plurality of stationary seals, such as o-rings, for receiving a piston.

An air compressor is disclosed including a housing, a motor mounted to the housing, a switch for turning the motor off, a piston assembly disposed within the housing, and a linkage assembly. The switch can be disposed at least partially within the housing. The carriage can be coupled to the piston assembly and can have a pivotally mounted arm. The linkage assembly can be disposed within the housing and can be moveable by the motor. The linkage assembly can be connected to the arm such that when the motor moves the linkage assembly, the linkage assembly can pivot the arm to move the switch.

In addition, an air compressor is disclosed including a housing and a piston assembly disposed within the housing. The piston assembly can include a piston housing, a first o-ring, a second o-ring, and a piston. The piston housing can have a first end and a second end, and can include an air inlet disposed between the first end and the second end. The first o-ring can be disposed within the piston housing between the first end and the air inlet. The second o-ring can be disposed within the piston housing between the second end and the air inlet. The piston can be disposed at least partially within the piston housing. The piston can be moveable with respect to the piston housing. The first o-ring and the second o-ring can be mounted stationary within the piston housing such that the piston is moveable within the first o-ring and the second o-ring.

Further, a piston assembly is disclosed including a piston housing, a first o-ring, a second o-ring, and a piston. The piston housing can have a first end and a second end, and can include an air inlet disposed between the first end and the second end. The first o-ring can be disposed within the piston housing between the first end and the air inlet. The second o-ring can be disposed within the piston housing between the second end and the air inlet. The piston can be disposed at least partially within the piston housing. The piston can be moveable with respect to the piston housing. The first o-ring and the second o-ring can be mounted stationary within the piston housing such that the piston is moveable within the first o-ring and the second o-ring.

DETAILED DESCRIPTION

Figure 1:
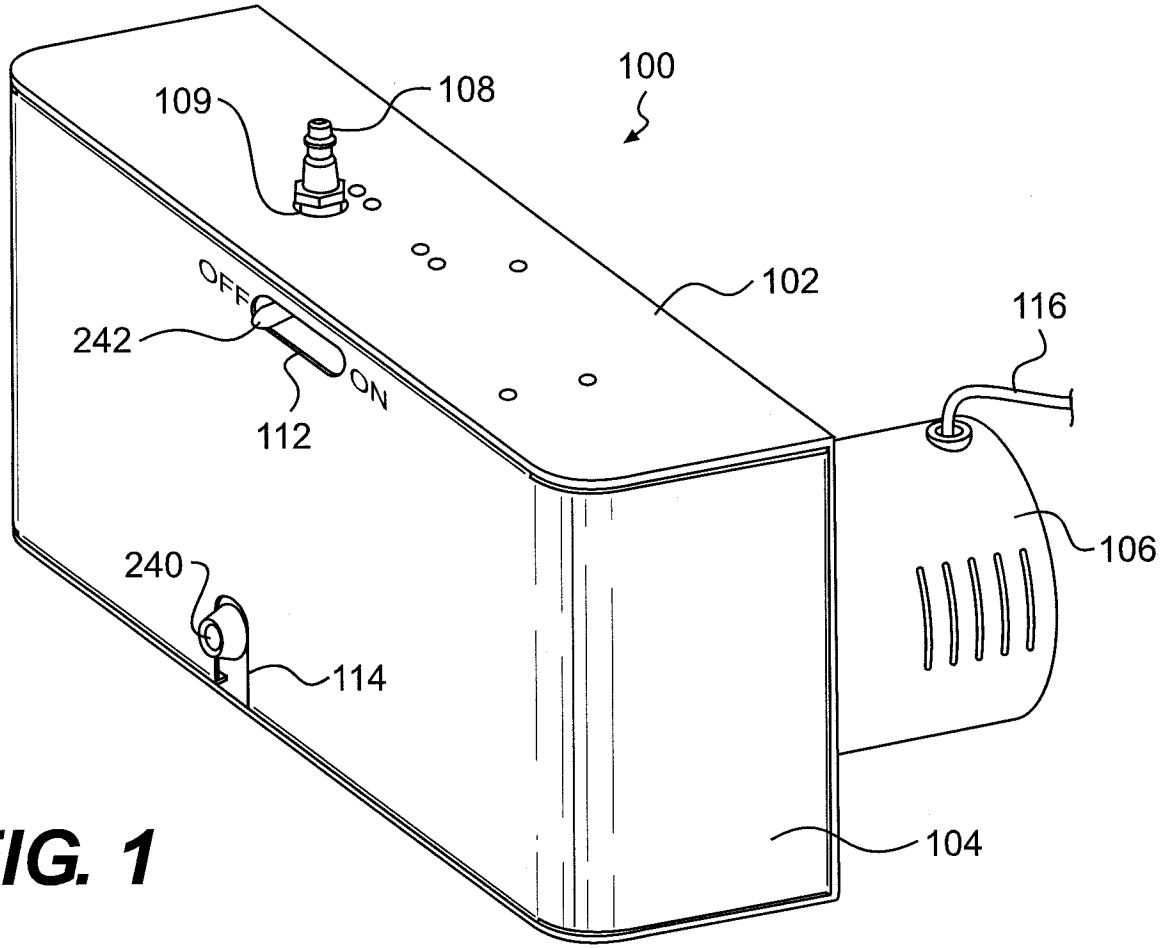
FIG. 1 is a perspective view of an air compressor.

With reference to the figures, wherein like reference numbers represent like features, an air compressor is described herein. Referring to FIG. 1, the air compressor 100 can include a housing 102, a cover 104, and a motor 106. The housing 102 can provide a portion of the external structure of the air compressor 100 for protecting the interior components. The housing 102 can also provide a support structure for mounting internal components of the air compressor 100. The housing 102 can include one or more apertures 109 providing access to interior components of the compressor and/or permitting one or more components to extend from the interior to the exterior of the air compressor 100. For example, an air input fitting 108 may extend from the housing 102 and provide a structure for attaching an air hose. The air input fitting 108 may be fixed to the air compressor 100 or can be removeable such that alternative fittings of different shapes and/or sizes could be used. The air input fitting 108 provides access to the compressor air input, which is described further below. It will be appreciated that the housing 102 can include any suitable number of apertures for any suitable number of purposes.

Figure 2:
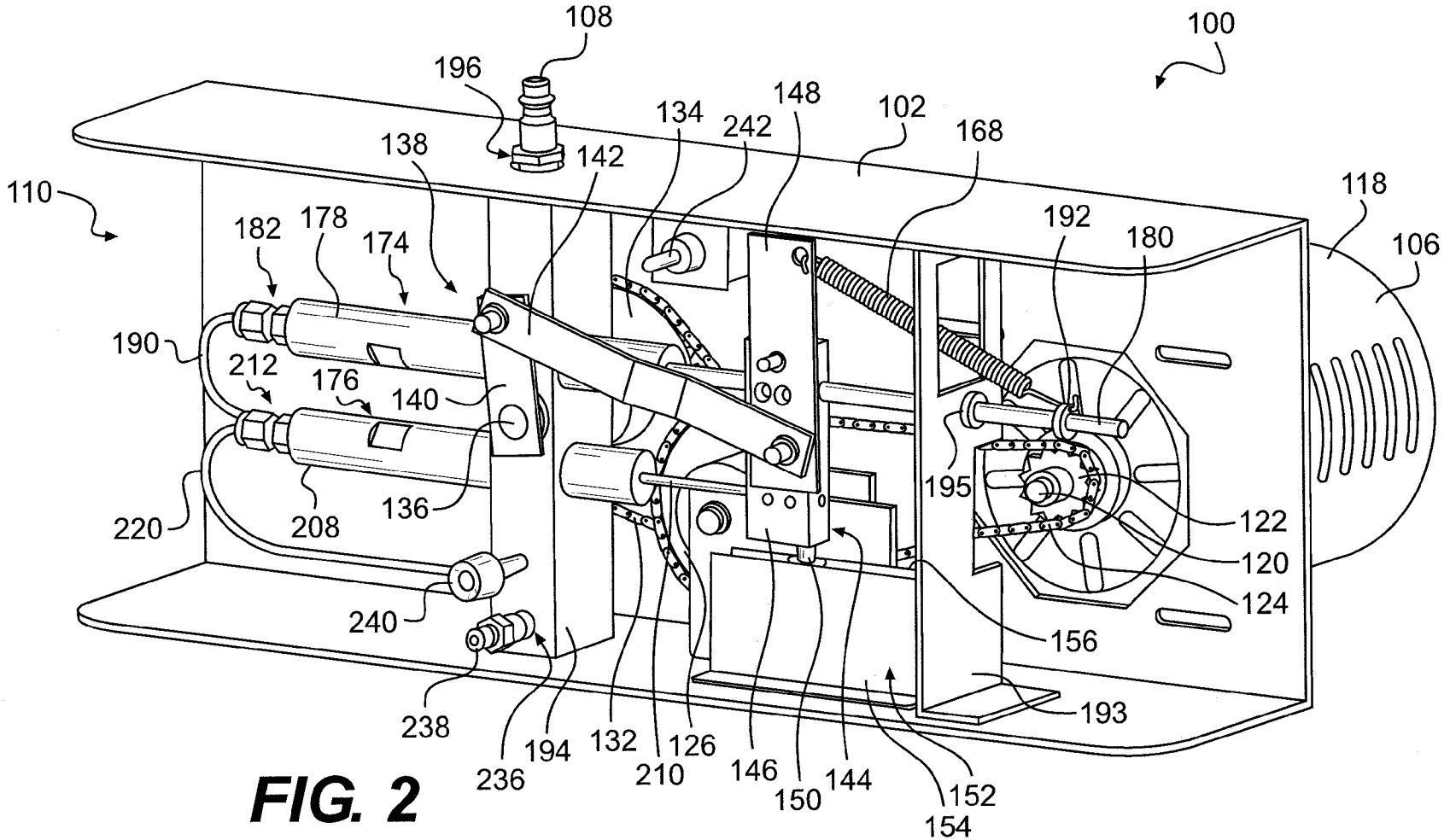
FIG. 2 is a perspective view of the air compressor of FIG. 1 with the cover removed.

Referring to FIG. 2, the housing 100 can include an opening 110 for providing access to the interior of the housing 102. Turning back to FIG. 1, the cover 104 can be disposed over the opening 110 in the housing 102 and can be removeable from the housing 102 in order to provide access to interior components of the air compressor 100. The cover 104 also protects the interior components of the housing 102 when the cover 104 is disposed over the opening 110 in the housing 102. The cover 104 can provide one or more apertures permitting access to interior components of the air compressor 100 and/or permitting one or more components to extend from the interior to the exterior of the air compressor 100. For example, the cover 104 can include an aperture 112 for a switch, which is described further below. As another example, the cover 104 can include an aperture 114 for a vent knob and/or an air compressor output, which are described further below. It will be appreciated that the cover 104 can include any suitable number of apertures for any suitable number of purposes. The motor 106 can be mounted to the housing, such as the rear of the housing, and may be removeable for servicing, replacement, and the like. As shown, the motor 106 can be an electric motor, and accordingly, can include a power cord 116. It will be appreciated, however, that any suitable motor could be used, such as a hydraulic or combustion motor.

Figure 3:
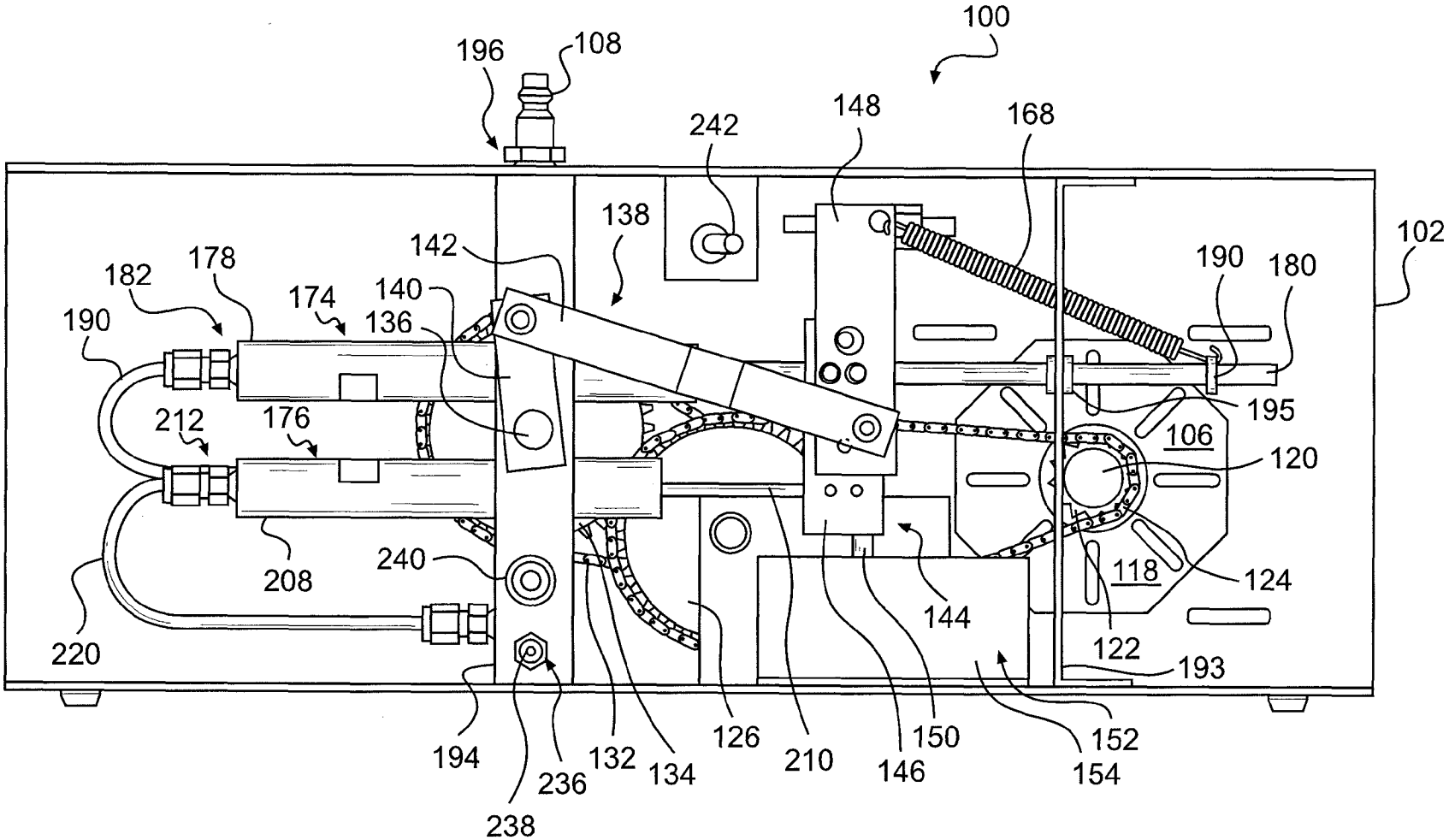
FIG. 3 is a front view of the air compressor of FIG. 1 with the cover removed.
Figure 5:
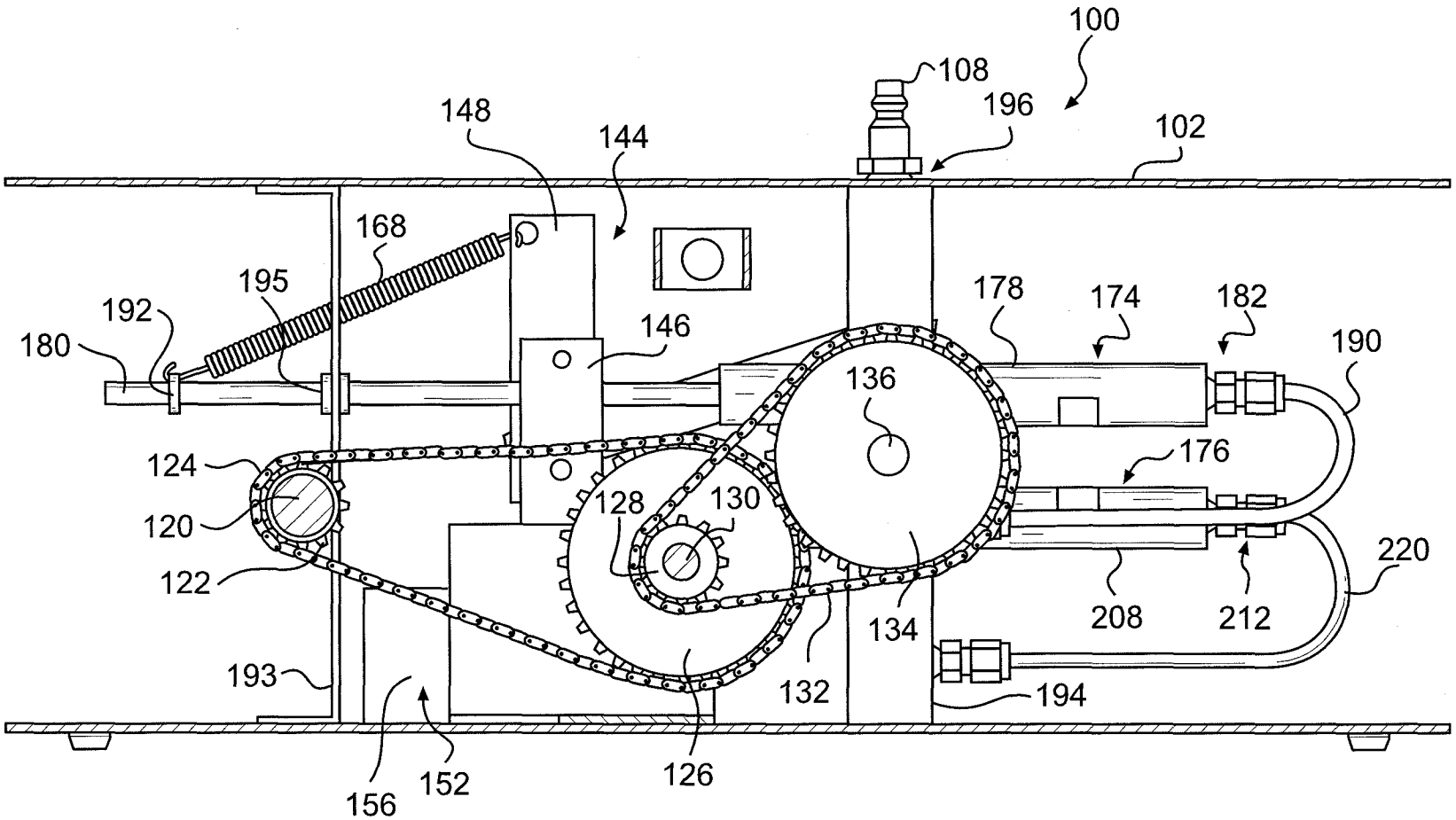
FIG. 5 is a section view taken through line 5-5 in FIG. 6.

Turning to FIGS. 2, 3, and 5-7, wherein the cover 104 has been removed for illustration, the interior components of the air compressor 100 are shown. The motor 106 can have a motor body 118 and a motor shaft 120 extending from the motor body 118. The motor shaft 120 can have a drive gear 122 fixed to the motor shaft 120. As shown in FIGS. 2, 3, and 5, the drive gear 122 can be connected via a motor chain 124 to a first transition gear 126. The first transition gear 126 may be fixed to a second transition gear 128 via a jackshaft 130. The second transition gear 128 can be connected by a jackshaft chain 132 to a linkage gear 134. As the motor 106 rotates, the drive gear 122 can turn the motor chain 124 to rotate the jackshaft 130 via the first transition gear 126. The rotation of the jackshaft 130 can also rotate second transition gear 128, which in turn rotates the linkage gear 134. It will be appreciated that the motor 106 may drive components of the air compressor 100 via any suitable number, types, and sizes of gears, shafts, and linkages.

Referring to FIGS. 2, 3, 5, and 6, the linkage gear 134 may be connected to a linkage shaft 136 to rotate a linkage assembly 138. As shown in FIGS. 2 and 3, the linkage assembly 138 can include a crank arm 140 and a connecting arm 142. The crank arm 140 may be mounted to the linkage shaft 136 near an end such that the crank arm 140 can be rotated by the linkage shaft 136. The connecting arm 142 can be pivotally attached to the crank arm 140 near another end of the crank arm 140. The other end of the connecting arm 142 can be pivotally attached to a carriage 144.

Figure 8:
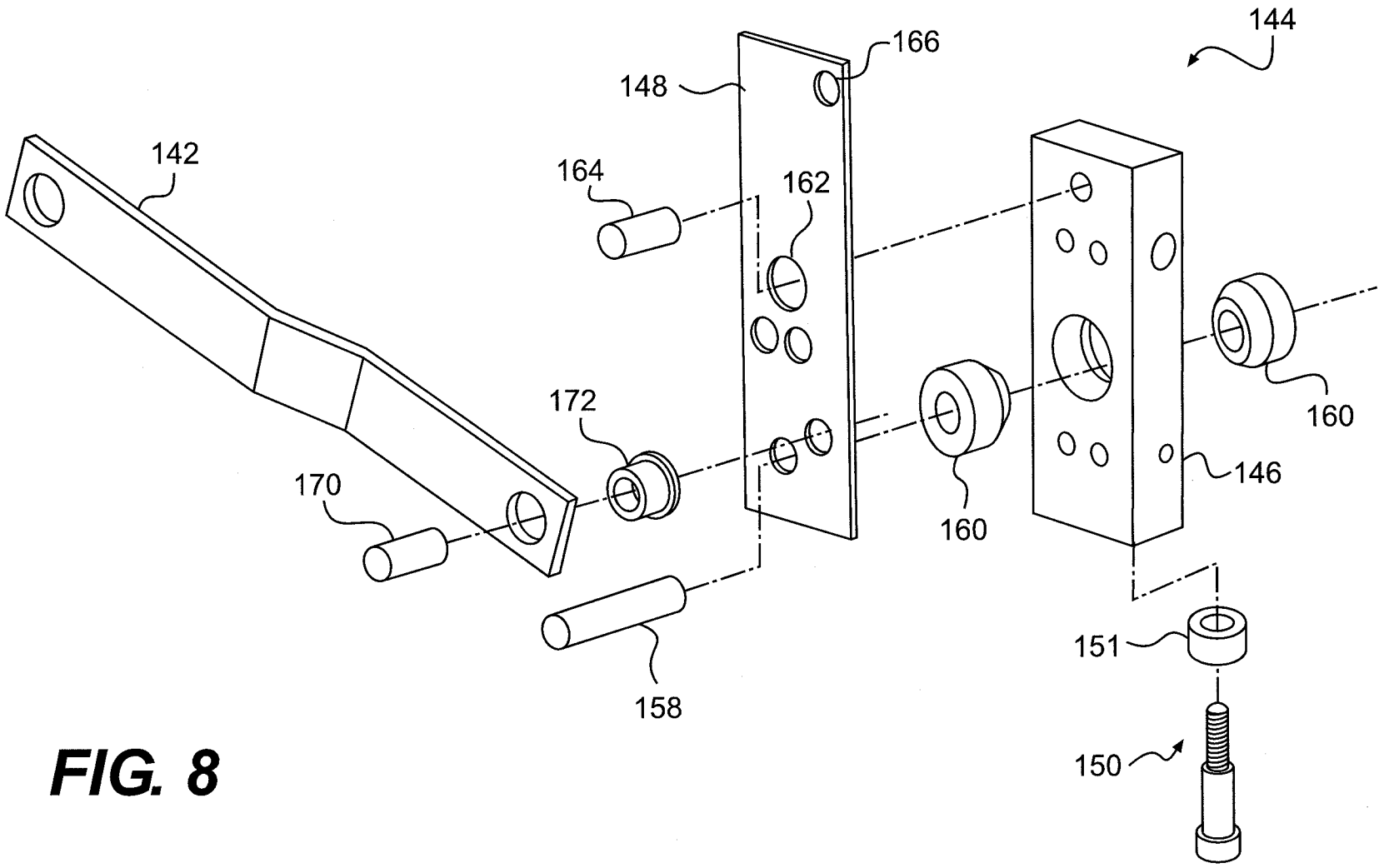
FIG. 8 is an exploded perspective view of a carriage and connecting arm for the air compressor of FIG. 1.

As shown in FIGS. 2, 3, and 8, the carriage 144 can include a shaft block 146, a release arm 148, and a guide pin 150. The carriage 144 can be linearly moveable as it is pulled and pushed by the connecting arm 142. The guide pin 150 can extend from the shaft block 146 such that it can ride within a guide bracket 152 as it moves. The guide bracket 152 can be mounted to the housing 102 and can include first and second parallel sidewalls 154, 156 that permit the guide pin 150 to travel therebetween. The guide pin 150 and guide bracket 152 can restrict movement of the carriage 144 in a direction perpendicular to the first and second sidewalls 154, 156, which alleviates stresses on the linkage assembly 138 when in motion.

Figure 9:
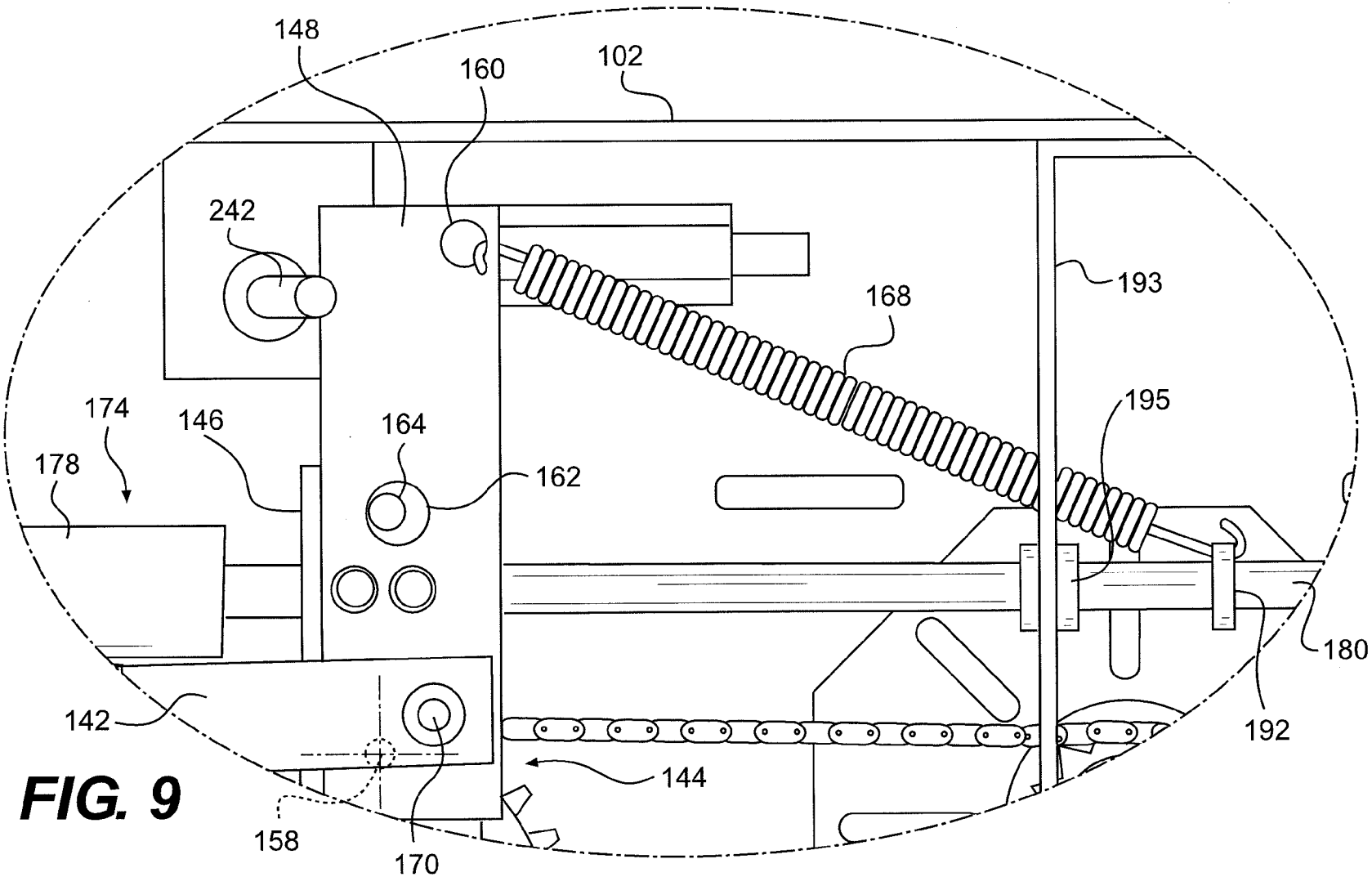
FIG. 9 is an enlarged fragmentary view of the carriage and switch for the air compressor of FIG. 1.

Referring to FIGS. 8 and 9, the release arm 148 may be pivotally attached to the shaft block 146 using a bolt 158 or other suitable structure and one or more roller bearings 160 that can fit at least partially within the shaft block 146. The release arm 148 can include an oversized aperture 162 that receives a projection 164 such as a bolt or other suitable structure extending from the shaft block 146. The oversized aperture 162 restricts the freedom of pivotal movement of the release arm 148 with respect to the shaft block 146. In addition, the release arm 148 can include a spring aperture 166 for receiving a tension spring 168. The connecting arm 142 can be pivotally attached to the release arm 148 with a bearing 172 and bolt 170 or other suitable structure. The guide pin 150 can extend from the shaft block 146, and can include a bearing 151.

Referring to FIGS. 2, 3, 6, and 11, the air compressor 100 can have one or more piston assemblies. For example, the air compressor 100 can include a first piston assembly 174 and a second piston assembly 176. The first piston assembly 174 can include a cylindrical housing 178, a piston 180, a back check valve 182, an air inlet 184, suitable sealing structures such as o-rings 186, 188 on each side of the air inlet 184, one or more spacers 187, 189, and an exit air line 190. The piston 180 can include a collar 192 for attaching the tension spring 168 to the piston 180. The piston 180 can be attached to and pass through the shaft block 146. The piston 180 can also pass through and be moveably coupled to a support bracket 193 that can be mounted to the housing 102. The piston 180 can be moveable within a bearing 195 mounted to the support bracket 193. The support bracket 193 can help to maintain the linear movement of the carriage 144 by resisting movement of the piston 180 and carriage 144 in a direction perpendicular to the longitudinal axis of the piston 180, which alleviates stresses on the linkage assembly 138 when in motion. In addition, the support bracket 193 can permit the tension spring 168 to pass therethrough.

The cylindrical housing 178 can include a chamber 179 for receiving a portion of the piston 180 at an end 183 and permitting movement of the piston 180 within the cylindrical housing 178. The air inlet 184 can be disposed on the sidewall of the cylindrical housing 178. When the first piston assembly 174 is assembled to the air compressor 100, the air inlet 184 can be disposed within an air block 194. The air block 194 can provide an internal pathway for air from the air input 196 to reach the air inlet 184 of the first piston assembly 174. Seals 198, 200 can be disposed on the outside of the cylindrical housing 178 on each side of the air inlet 184 for contacting the interior of the air block 194.

Likewise, the sealing structures, shown as two o-rings 186, 188, can be disposed on each side of the air inlet 184 within the chamber 179 and can be mounted such that they are stationary within the chamber 179. The o-rings 186, 188 can be sized to receive the piston 180. The o-rings 186, 188 can be mounted in a stationary position such that they do not move as the piston 180 moves through them. The o-rings 186, 188 can be maintained in a stationary position using one or more spacers 187, 189, which can be tubular or any other suitable shape. For example, spacer 187 can be disposed within the chamber 179 between the o-rings 186, 188 to maintain a desired spacing between the o-rings 186, 188 and to help hold the o-rings 186, 188 in a stationary position. As shown, spacer 187 can hold o-ring 186 against a ledge in the chamber 179 formed by a change in diameter of the chamber 179. The spacer 187 can have one or more apertures 197 for allowing air into the interior of the spacer 187. Another spacer 189 can also be provided near the end 183 to help hold the o-rings 186, 188 in a stationary position. As shown, o-ring 188 can be held in position between the spacers 187, 189. The piston 180 can be disposed within the spacers 187, 189. A threaded nut 185 can be provided at the end 183, which can be tightened to further secure and retain the o-rings 186, 188 and spacers 187, 189 in position. The threaded nut 185 can also be removed to provide access to the chamber 179 for repair or replacement of parts. It will be appreciated that the sealing structures, such as o-rings 186, 188, can be mounted in a stationary position in any suitable manner. In addition, the sealing structures, such as o-rings 186, 188, can have any suitable shape and can be made of any suitable material.

Figure 6:
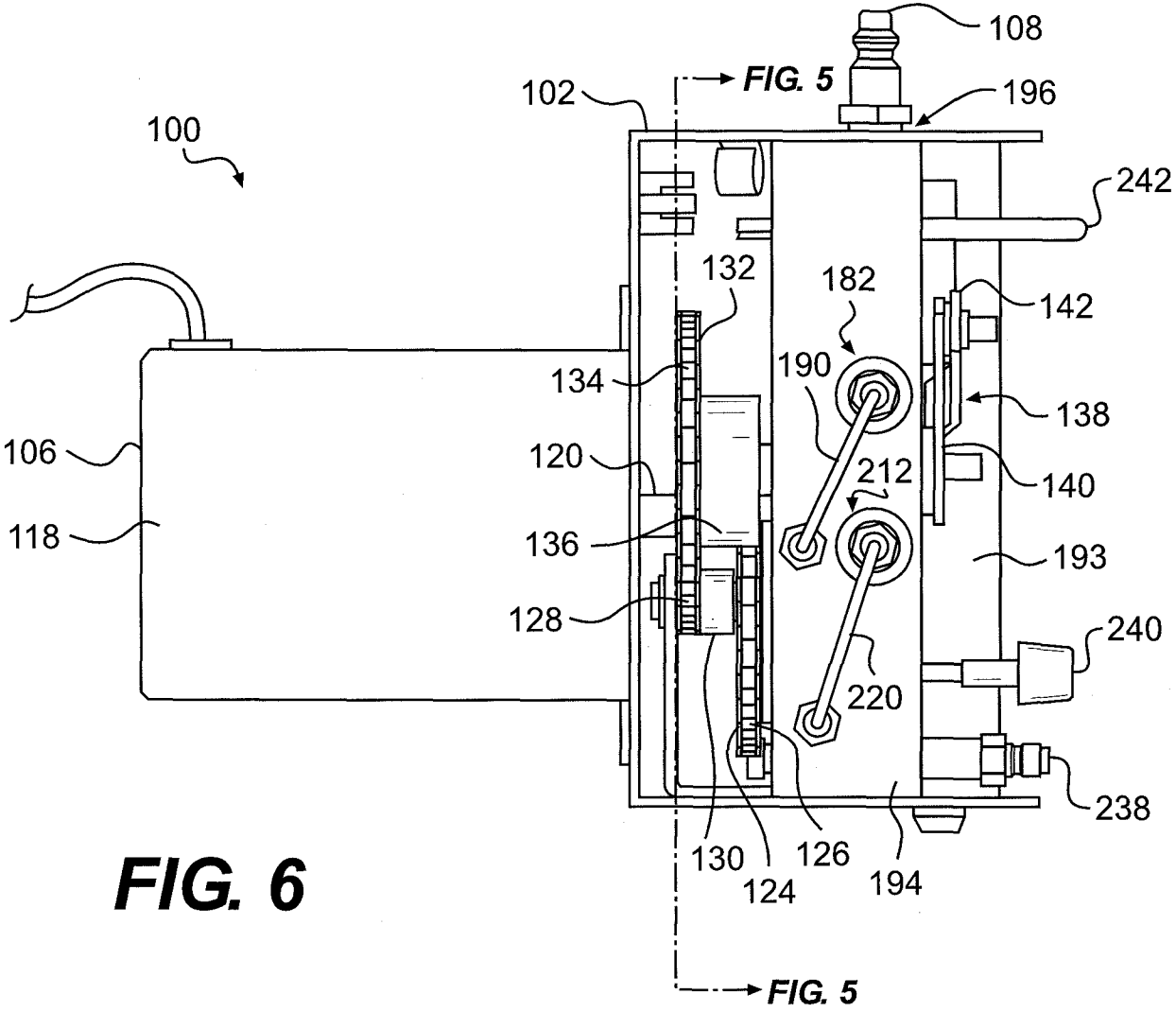
FIG. 6 is a left elevational side view of the air compressor of FIG. 1 with the cover removed.
Figure 7:
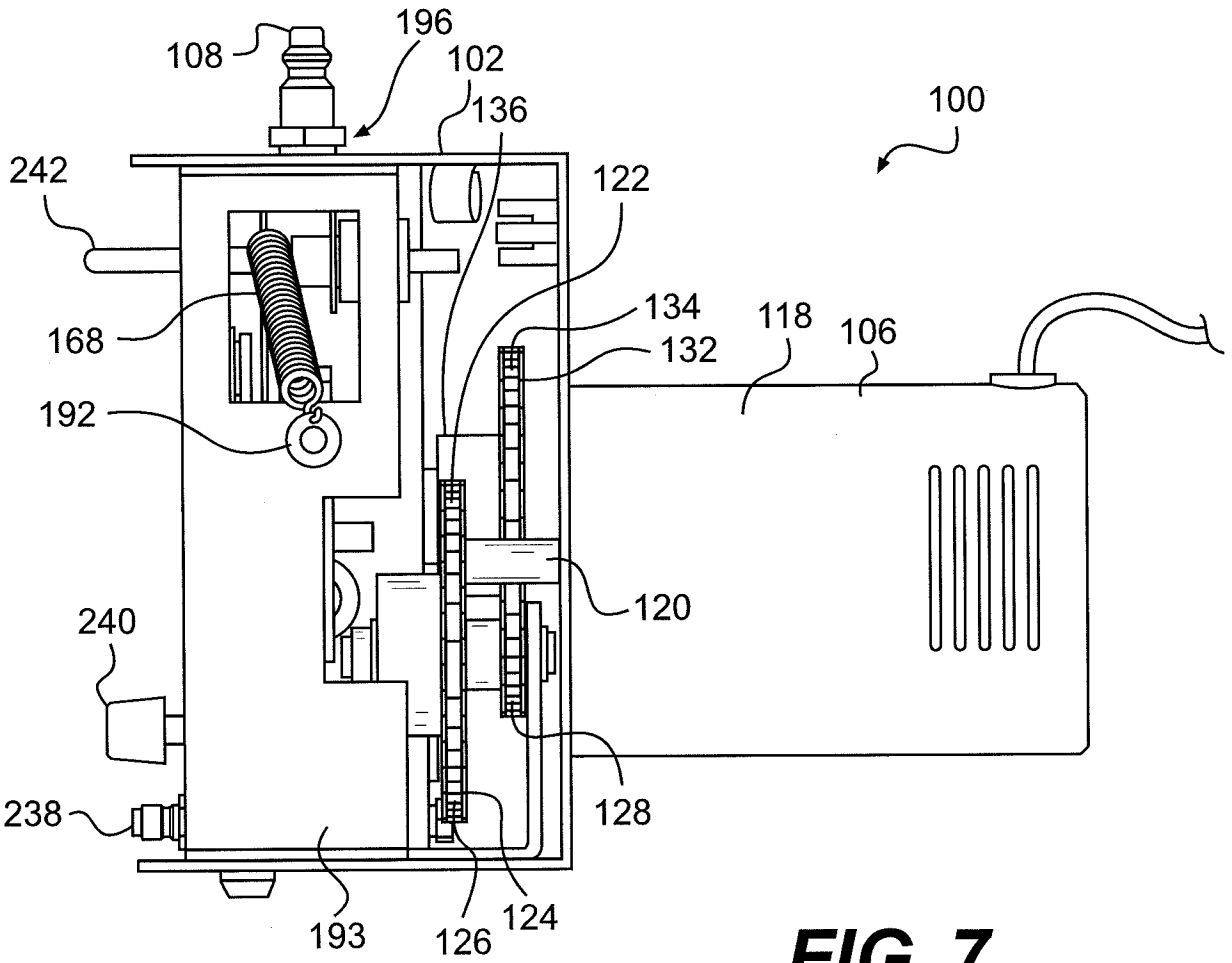
FIG. 7 is a right elevational side view of the air compressor of FIG. 1 with the cover removed.

The back check valve 182 can include a spring 202, a plug 204, and a seal 206 to restrict the flow of air to a single direction toward the exit air line 190. The seal 206 can be an o-ring, which can be mounted to the plug 204 within the cylindrical housing 178. When the valve 182 is closed, the seal 206 can abut a ledge formed by a change in diameter of the chamber 179. The spring 202 can bias the plug 204 and seal 206 against the ledge. The valve 182 can open by moving away from the ledge when a particular pressure is reached in the chamber 179. When this occurs, air is permitted to flow through a space between the plug 204 and the chamber 179 and then into the exit air line 190. The exit air line 190 is attached to an end 181 of the piston housing 178 and feeds to an inlet for the second piston assembly 176. As shown in FIG. 6, the exit air line 190 can feed into the air block 194, which can provide an internal conduit to an air inlet 214 for the second piston assembly 176.

Referring again to FIGS. 2, 3, 6, and 11, the air compressor can include a second piston assembly 176 that can be similar to the first piston assembly 174. The second piston assembly 176 can include a cylindrical housing 208, a piston 210, a back check valve 212, an air inlet 214, suitable sealing structures such as o-rings 216, 218 on each side of the air inlet 214, and an exit air line 220. The piston 210 can be attached to the shaft block 146. The cylindrical housing 208 can include a chamber 209 for receiving a portion of the piston 210 at an end 213 and permitting movement of the piston 210 within the cylindrical housing 208. The air inlet 214 can be disposed on the sidewall of the cylindrical housing 208. When the second piston assembly 176 is assembled to the air compressor 100, the air inlet 214 can be disposed within the air block 194. The air block 194 can provide an internal pathway for air from the exit air line 190 of the first piston assembly 174 to reach the air inlet 214 of the second piston assembly 176. Seals 222, 224 can be disposed on the outside of the cylindrical housing 208 on each side of the air inlet 214 for contacting the interior of the air block 194.

Likewise, the sealing structures, shown as two o-rings 216, 218, can be disposed on each side of the air inlet 214 within the chamber 209 and can be mounted such that they are stationary within the chamber 179. The o-rings 216, 218 can be sized to receive the piston 210. The o-rings 216, 218 can be mounted in a stationary position such that they do not move as the piston 210 moves through them. The o-rings 216, 218 can be maintained in a stationary position using one or more spacers 217, 219, which can be tubular or any other suitable shape. For example, spacer 217 can be disposed within the chamber 209 between the o-rings 216, 218 to maintain a desired spacing between the o-rings 216, 218 and to help hold the o-rings 216, 218 in a stationary position. As shown, spacer 217 can hold o-ring 216 against a ledge in the chamber 209 formed by a change in diameter of the chamber 209. The spacer 217 can have one or more apertures 227 for allowing air into the interior of the spacer 217. Another spacer 219 can also be provided near the end 213 to help hold the o-rings 216, 218 in a stationary position. As shown, o-ring 218 can be held in position between the spacers 217, 219. The piston 210 can be disposed within the spacers 217, 219. A threaded nut 215 can be provided at the end 213, which can be tightened to further secure and retain the o-rings 216, 218 and spacers 217, 219 in position. The threaded nut 215 can also be removed to provide access to the chamber 209 for repair or replacement of parts. It will be appreciated that the sealing structures, such as o-rings 216, 218, can be mounted in a stationary position in any suitable manner. In addition, the sealing structures, such as o-rings 216, 218, can have any suitable shape and can be made of any suitable material.

The back check valve 212 can include a spring 230, a plug 232, and a seal 234 to restrict the flow of air to a single direction toward the exit air line 220. The seal 234 can be an o-ring, which can be mounted to the plug 232 within the cylindrical housing 208. When the valve 212 is closed, the seal 234 can abut a ledge formed by a change in diameter of the chamber 209. The spring 230 can bias the plug 232 and seal 234 against the ledge. The valve 212 can open by moving away from the ledge when a particular pressure is reached in the chamber 209. When this occurs, air is permitted to flow through a space between the plug 232 and the chamber 209 and then into the exit air line 220. As shown in FIG. 6, the exit air line 220 can be attached to an end 211 of the piston housing 208 and can feed into the air block 194, which can provide an internal conduit to an air output 236 of the air compressor 100 extending from the air block 194. The air output 236 can be accessed through an aperture 114 in the cover 104 shown in FIG. 1, and an output fitting 238 can be attached to the air output 236 as shown in FIG. 2.

Figure 11:
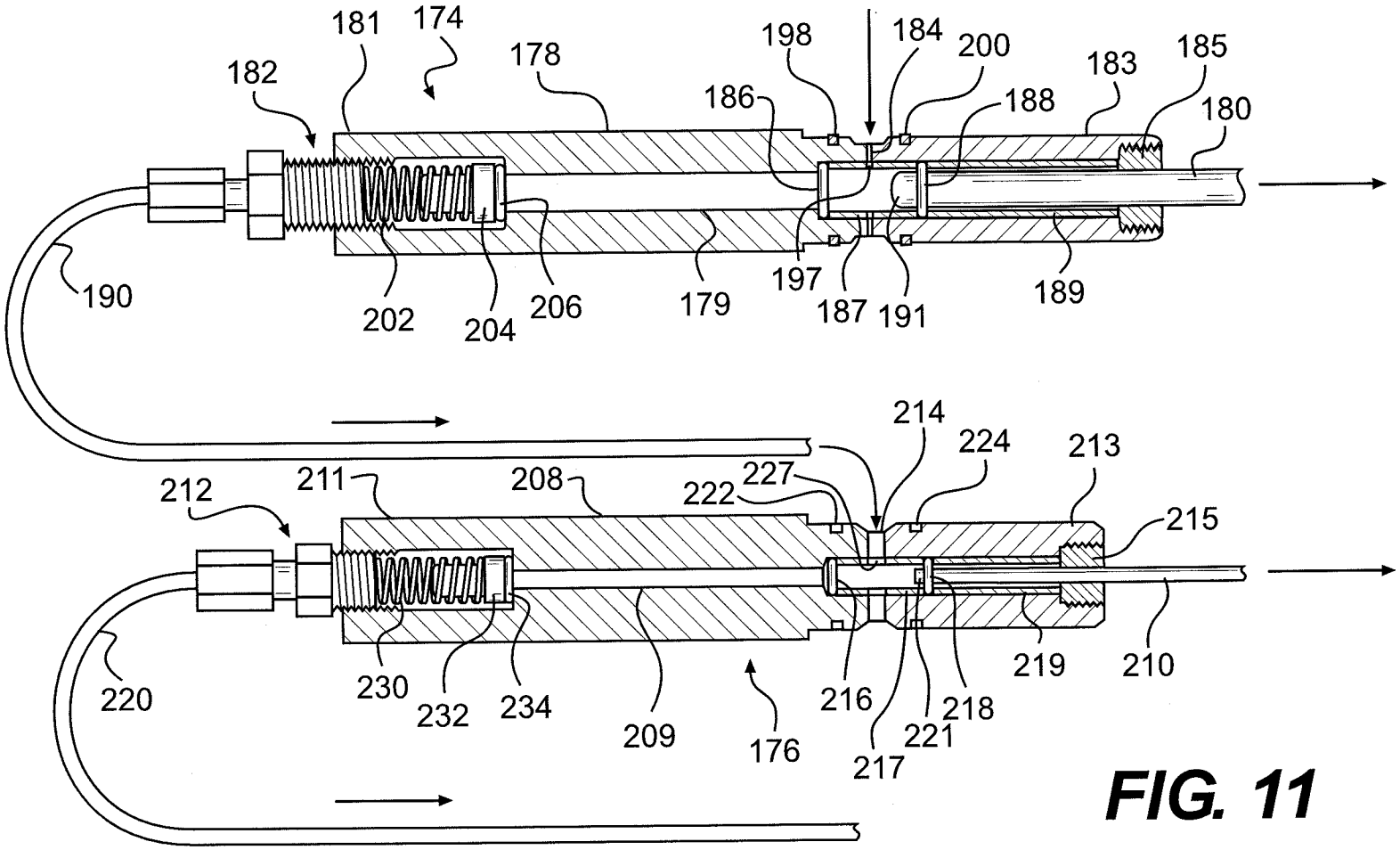
FIG. 11 is a simplified fragmentary partial sectional view of two piston assemblies with the pistons retracted for the air compressor of FIG. 1.

It will be appreciated that the second piston chamber 209 can be of a different size than the first piston chamber 179. As shown in FIG. 11, the second piston chamber 209 can have a smaller diameter than the first piston chamber 179 in order to expel the air provided into the second piston chamber 209 at a higher pressure than the air expelled from the first piston chamber 179.

Referring to FIGS. 1 and 2, the air block 194 can include a vent knob 240 that can be rotated to a position that allows air in the compressor 100 to be vented. The vent knob 240 can extend out through an aperture 114 in the cover 104 such that a user can access the vent knob 240 when the cover 104 is mounted to the housing 102. In addition, the air compressor 100 can include a switch 242 for turning the air compressor 100 on and off. The switch 242 can be electrically connected to the motor 106 to turn the motor 106 on and off. The switch 242 can extend out through an aperture 112 in the cover 104 such that a user can access the switch 242 when the cover 104 is mounted to the housing 102.

During operation, as described further below, the switch 242 can be moved from the on position to the off position by the release arm 148. The switch 242 can include a sleeve in the form of a spring that slides over and extends from the switch 242. The central axis of the spring can align with the central axis of the switch 242. The sleeve can be longer than the switch 242 and can operate as an extension to the length of the switch 242. The sleeve can extend through the aperture 112 for gripping the switch 242 from the exterior of the air compressor 100.

For example purposes only, the operation of an embodiment of the air compressor 100 will be described herein. Referring again to FIG. 1, a user may provide a supply of air via a hose connected to the air input fitting 108. The input air supply may be at a relatively low pressure, such as may be provided by a common shop compressor. In one embodiment, the input air may be provided at approximately 85 psi. It will be appreciated, however, that the input air supply may be at any suitable pressure. A hose may also be used to connect the air output 236 to a tank or other storage vessel being filled. The motor may then be activated by moving the switch to the on position.

Turning to FIGS. 2, 3, and 5, once activated, the motor 106 can rotate the motor shaft 120 and the drive gear 122, which can turn the first transition gear 126 and the jackshaft 130 via the motor chain 124. The second transition gear 128 can rotate with the jackshaft 130 to rotate the linkage gear 134 and linkage shaft 136 via the jackshaft chain 132. The rotation of the linkage shaft 136 can rotate the crank arm 140 360° about the linkage shaft 136. As the crank arm 140 rotates, it can pull and push the carriage 144 via the connecting arm 142. For example, when the crank arm 140 has been rotated from the position shown in FIG. 3 to the position shown in FIG. 4, the connecting arm 142 can be approximately horizontal and the carriage 144 can be pulled to approximately its closest position to the switch 242. As the crank arm 140 continues to rotate from the position shown in FIG. 4, it can push the carriage 144 away from the switch 242 via the connecting arm 142.

Figure 4:
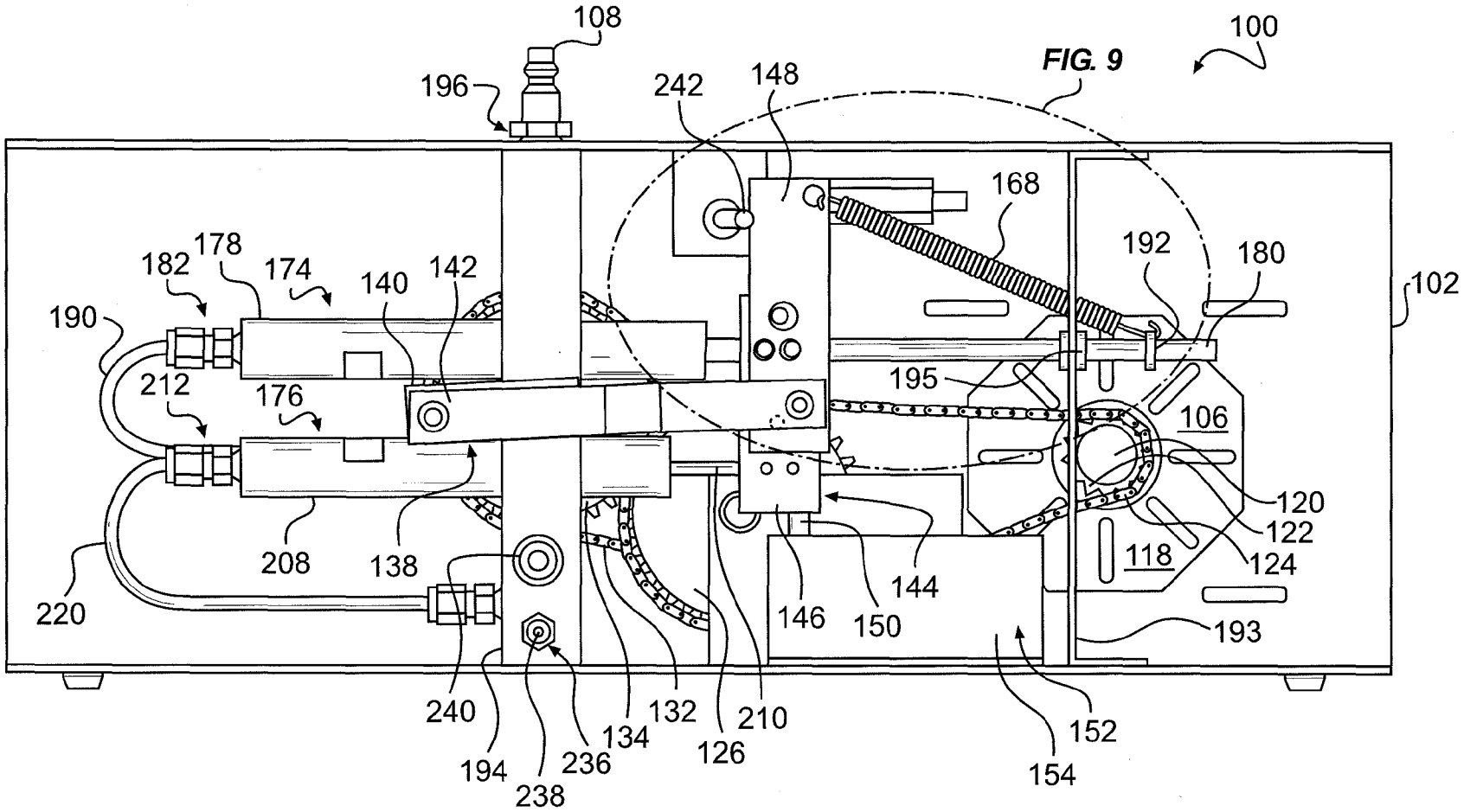
FIG. 4 is another front view of the air compressor of FIG. 1 with the cover removed.
Figure 12:
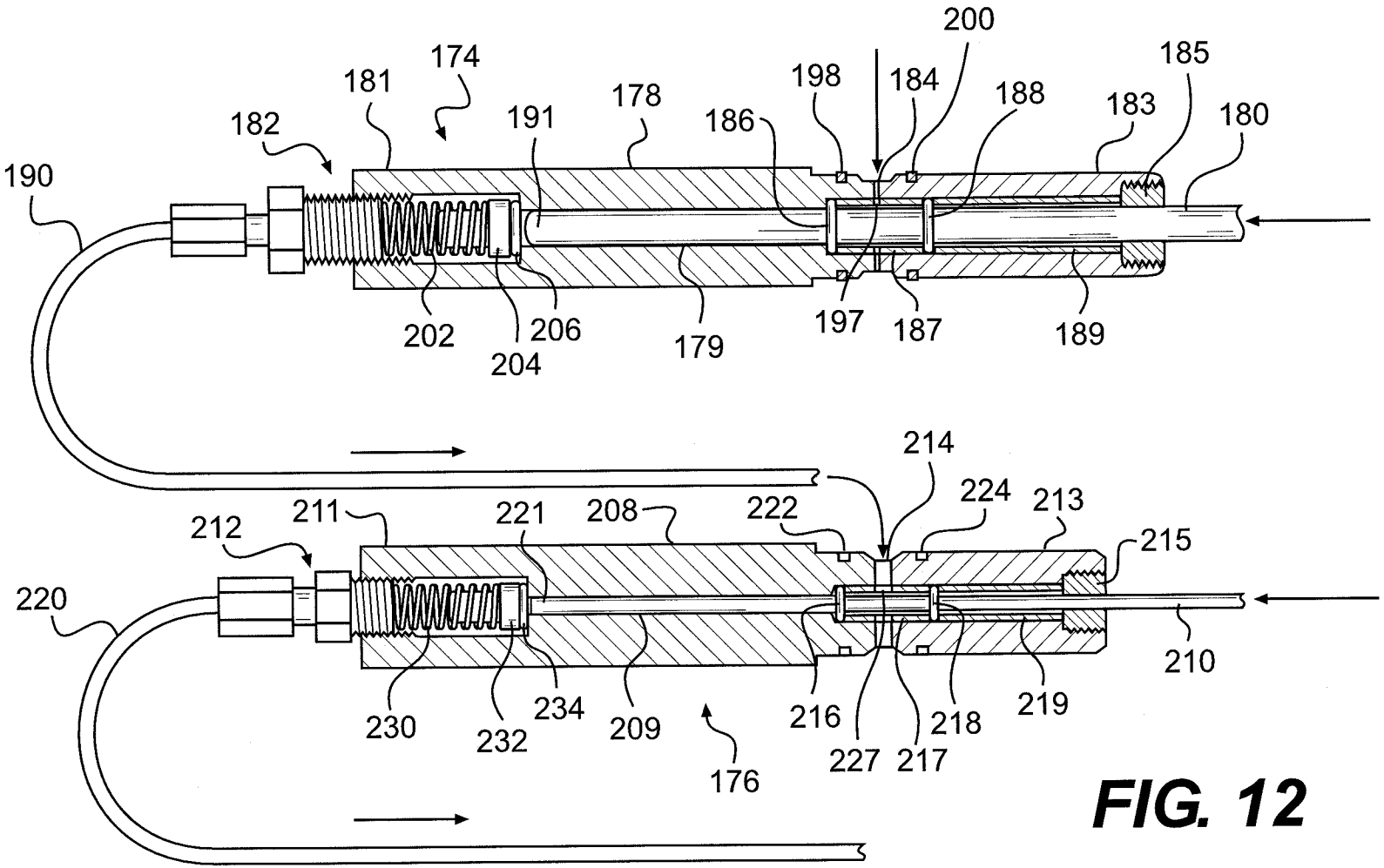
FIG. 12 is another simplified fragmentary partial sectional view of two piston assemblies with the pistons advanced for the air compressor of FIG. 1.

Referring to FIGS. 2-4, as the carriage 144 moves toward and away from the switch 242, its movement can be maintained in a generally linear direction by the guide pin 150 riding between the sidewalls 154, 156 of the guide bracket 152 and/or the piston 180 extending through the support bracket 193. As the carriage 144 moves, it moves the first and second pistons 180, 210 both away from the back check valves 182, 212, as shown in FIG. 11, and toward the back check valves 182, 212 as shown in FIG. 12. As the first and second pistons 180, 210 move, the o-rings 186, 188, 216, 218 on each side of the air inlets 184, 214 remain stationary. As shown in FIG. 11, when the pistons 180, 210 are pulled to the furthest extent away from the back check valves 182, 212, the ends 191, 221 of the pistons 180, 210 can be between the respective two o-rings 186, 188, 216, 218 in each chamber 179, 209. This permits the air from the respective air inlets 184, 214 to enter into the chambers 179, 209. The carriage 144 can then begin to push the pistons 180, 210 toward the back check valves 182, 212, as shown in FIG. 12, such that the pistons 180, 210 pass through the o-rings 186, 216 positioned closer to the back check valves 182, 212. When this occurs, the respective inlets 184, 214 are cut off from portions of the chambers 179, 209 by the seal formed between the o-rings 186, 216 and the pistons 180, 210. As the pistons 180, 210 continue to move toward the back check valves 182, 212, they compress the air in the chambers 179, 209 and send the compressed air past the respective back check valves 182, 212.

Referring again to FIGS. 11 and 12, as the pistons 180, 210 move away from the back check valves 182, 212 with the next stroke, the o-rings 186, 216 closer to the back check valves 182, 212 do not permit air to flow past the o-rings 186, 216 when the pistons 180, 210 are still encircled by the o-rings 186, 216, which forms a vacuum within the chambers 179, 209 when the pistons 180, 210 are retracted. The vacuum creates a vacuum force against the o-rings 186, 216 that helps to counter-balance the friction force asserted against the o-rings 186, 216 by the moving pistons 180, 210. The counteracting vacuum and friction forces can help reduce the amount of wear experienced by the o-rings 186, 216.

The motor 106 can continue to drive the pistons 180, 210 until the switch 242 is turned off. The air compressor 100 can be equipped with an automatic shut-off mechanism to turn off the air compressor 100 when a desired pressure has been reached in a piston assembly. The automatic shut-off mechanism can be a mechanical structure incorporated into the carriage 144. Referring to FIG. 9, prior to the desired pressure being reached in the piston assemblies 174, 176, the carriage 144 can move back and forth within the housing 102 such that the carriage 144 will not contact the switch 242 with sufficient force to turn it off, even when the carriage 144 is in its closest position to the switch 242. As mentioned, the release arm 148 may be pivotally mounted to the shaft block 146. As shown in FIG. 9, the pivot connection at 170 of the connecting arm 142 with the release arm 148 can be offset with respect to the pivot connection at 158 of the release arm 148 with the shaft block 146. Thus, as the connecting arm 142 pulls the carriage 144, a pivot force is created about the pivot connection at 158 of the release arm 148 and the shaft block 146. Before an approximate desired pressure in the piston assemblies 174, 176 reaches a certain threshold, the spring force exerted by the spring 168 attached to the release arm 148 and piston collar 192 counterbalances the pivot force created by the connecting arm 142.

Figure 10:
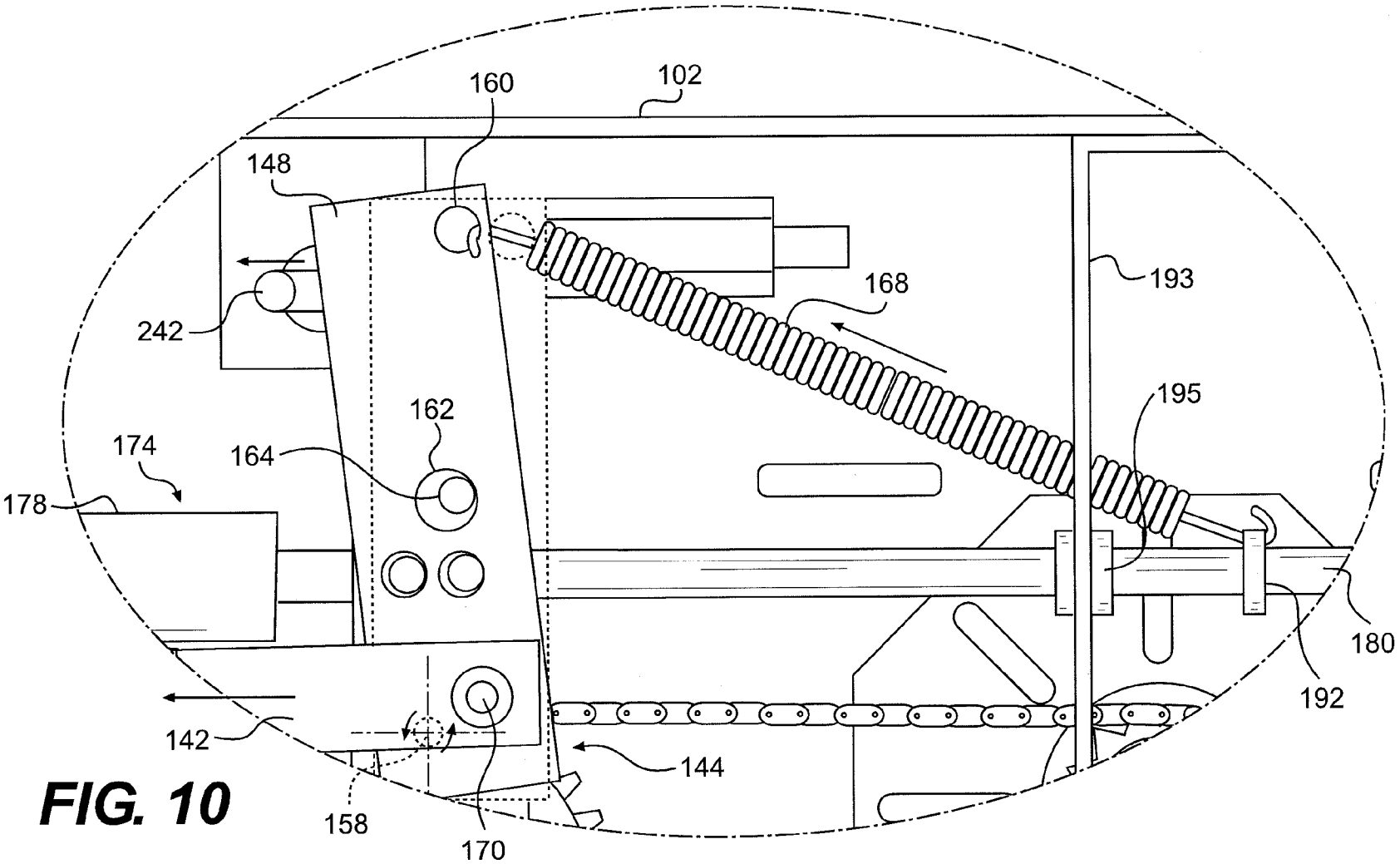
FIG. 10 is another enlarged fragmentary view of the carriage and switch for the air compressor of FIG. 1

The amount of pivot force is related to the amount of pressure in the piston assemblies 174, 176. When the connecting arm 142 is pulling the carriage 144 and second piston 210 toward the back check valve 212, the pressure in the piston assemblies 174, 176 exerts a force against the piston 210 and carriage 144. The connecting arm 142 works against this force in order to pull the carriage 144 toward the switch 242, but the pivot force about the pivot connection at 158 between the release arm 148 and shaft block 146 increases with the increase in pressure in the piston assemblies 174, 176. Thus, when a certain piston assembly pressure threshold is reached, the pivot force will be great enough to overcome the spring force of the spring, which permits the release arm 148 to rotate with respect to the shaft block 146 as shown in FIG. 10. The distance that the release arm 148 can pivot is limited by the size of the oversized aperture 162 in the release arm 148 and the projection 164 within the aperture 162, which can act as a pivot stop in both pivoting directions. When the spring force has been overcome a sufficient amount to pivot the release arm 148 far enough to move the switch 242, the switch 242 will be forced to the off position.

It will be appreciated that the shut-off pressure can be adjusted by using a spring 168 capable of asserting a different spring force, and/or by altering various connection positions on the release arm 148. For example, the shut-off pressure can be affected by modifying the chosen positions of the connecting arm/release arm pivot connection at 170, the release arm/drive block pivot connection at 158, and/or the position of the spring aperture 160. It will be appreciated that the automatic shut-off mechanism can include any suitable structure to shut off the air compressor 100 at any desired pressure.

Thus, the air compressor 100 can operate as a two-stage compressor that takes in air at particular pressure, compresses that air to a higher pressure in the first piston assembly 174, and then further compresses the air to an even higher pressure with the second piston assembly 176. The pressure of the compressed air at each stage can be any suitable amount. By way of example and not limitation, in certain embodiments, the air compressor can take in air at approximately 85 psi and further compress the air to approximately 800 psi with the first piston assembly 174. This higher pressure air can then be fed into the second piston assembly 176 for further compression to approximately 4500 psi. In addition, once a certain pressure in a piston assembly has been reached, the air compressor 100 can include a mechanical structure for shutting off the air compressor 100. The particular piston assemblies utilized can help determine the amount of compression through the air compressor 100.

The air compressor is capable of providing compressed air at a high pressure suitable for filling paintball gun tanks, scuba tanks, and any other suitable applications.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An air compressor comprising:

a housing;

a motor mounted to the housing;

a switch for turning the motor off, the switch being disposed at least partially within the housing;

a piston assembly disposed within the housing;

a carriage coupled to the piston assembly, the carriage including a pivotally mounted release arm;

a linkage assembly disposed within the housing and moveable by the motor, the linkage assembly being connected to the release arm such that when the motor moves the linkage assembly, the linkage assembly can pivot the release arm to move the switch.

2. The air compressor of claim 1 wherein the piston assembly includes:

a piston housing including a first end and a second end, the piston housing including an air inlet disposed between the first end and the second end;

a first o-ring disposed within the piston housing, the first o-ring being disposed between the first end and the air inlet;

a second o-ring disposed within the piston housing, the second o-ring being disposed between the second end and the air inlet;

a piston disposed at least partially within the piston housing, the piston being moveable with respect to the piston housing, the first o-ring and the second o-ring being mounted stationary within the piston housing such that the piston is moveable within the first o-ring and the second o-ring.

3. The air compressor of claim 2 further comprising a spacer disposed within the piston housing, the first o-ring and the second o-ring being mounted stationary within the piston housing with the spacer.

4. The air compressor of claim 2 wherein the piston is moveable within the piston housing from a first position wherein the piston is disposed within both the first o-ring and the second o-ring, and a second position wherein the piston is removed from the first o-ring and disposed within the second o-ring.

5. The air compressor of claim 4 wherein when the piston is moved from the first position to the second position, a vacuum is formed in the piston housing between the first end and the first o-ring.

6. The air compressor of claim 2 further comprising a second piston assembly, the second piston assembly including:

a second piston assembly housing including a second piston assembly first end and second end, the second piston assembly housing including a second piston assembly air inlet disposed between the second piston assembly first end and the second piston assembly second end;

a second piston assembly first o-ring disposed within the second piston assembly housing, the second piston assembly first o-ring being disposed between the second piston assembly first end and the second piston assembly air inlet;

a second piston assembly second o-ring disposed within the second piston assembly housing, the second piston assembly second o-ring being disposed between the second piston assembly second end and the second piston assembly air inlet;

a second piston assembly piston disposed at least partially within the second piston assembly housing, the second piston assembly piston being moveable with respect to the second piston assembly housing, the second piston assembly first o-ring and the second piston assembly second o-ring being mounted stationary within the second piston assembly housing such that the second piston assembly piston is moveable within the second piston assembly first o-ring and the second piston assembly second o-ring.

7. The air compressor of claim 1 further comprising a second piston assembly.

8. The air compressor of claim 1 wherein the release arm includes an aperture and the carriage includes a projection extending through the aperture, and wherein a diameter of the aperture is larger than a diameter of the projection.

9. The air compressor of claim 1 wherein the linkage assembly includes a crank arm and a connecting arm, the connecting arm being pivotally connected to the release arm.

10. The air compressor of claim 9 wherein when the connecting arm is moved by the crank arm, the connecting arm moves the carriage back and forth along a generally linear path.

11. The air compressor of claim 9 further comprising a spring connected to the release arm, wherein when a pivot force exerted by the connecting arm on the release arm exceeds a pivot force exerted by the spring on the release arm, the release arm pivots on the carriage, and wherein when the pivot force exerted by the connecting arm on the release arm does not exceed the pivot force exerted by the spring on the release arm, the release arm is held in place on the carriage.

12. The air compressor of claim 11 wherein when the release arm is pivoted by the connecting arm, the release arm moves the switch.

13. An air compressor comprising:

a housing; and a piston assembly disposed within the housing, the piston assembly including:

a piston housing including a first end and a second end, the piston housing including an air inlet disposed between the first end and the second end;

a first o-ring disposed within the piston housing, the first o-ring being disposed between the first end and the air inlet;

a second o-ring disposed within the piston housing, the second o-ring being disposed between the second end and the air inlet; and a piston disposed at least partially within the piston housing, the piston being moveable with respect to the piston housing, the first o-ring and the second o-ring being mounted stationary within the piston housing such that the piston is moveable within the first o-ring and the second o-ring;

wherein the piston is moveable within the piston housing from a first position wherein the piston is disposed within both the first o-ring and the second o-ring, and a second position wherein the piston is removed from the first o-ring and disposed within the second o-ring.

14. The air compressor of claim 13 further comprising a spacer disposed within the piston housing, the first o-ring and the second o-ring being mounted stationary within the piston housing with the spacer.

15. The air compressor of claim 13 further comprising a second piston assembly, the second piston assembly including:

a second piston assembly housing including a second piston assembly first end and second end, the second piston assembly housing including a second piston assembly air inlet disposed between the second piston assembly first end and the second piston assembly second end;

a second piston assembly first o-ring disposed within the second piston assembly housing, the second piston assembly first o-ring being disposed between the second piston assembly first end and the second piston assembly air inlet;

a second piston assembly second o-ring disposed within the second piston assembly housing, the second piston assembly second o-ring being disposed between the second piston assembly second end and the second piston assembly air inlet;

a second piston assembly piston disposed at least partially within the second piston assembly housing, the second piston assembly piston being moveable with respect to the second piston assembly housing, the second piston assembly first o-ring and the second piston assembly second o-ring being mounted stationary within the second piston assembly housing such that the second piston assembly piston is moveable within the second piston assembly first o-ring and the second piston assembly second o-ring.

16. The air compressor of claim 13 wherein when the piston is moved from the first position to the second position, a vacuum is formed in the piston housing between the first end and the first o-ring.

17. A piston assembly comprising:

a piston housing including a first end and a second end, the piston housing including an air inlet disposed between the first end and the second end;

a first o-ring disposed within the piston housing, the first o-ring being disposed between the first end and the air inlet;

a second o-ring disposed within the piston housing, the second o-ring being disposed between the second end and the air inlet; and a piston disposed at least partially within the piston housing, the piston being moveable with respect to the piston housing, the first o-ring and the second o-ring being mounted stationary within the piston housing such that the piston is moveable within the first o-ring and the second o-ring;

wherein the piston is moveable within the piston housing from a first position wherein the piston is disposed within both the first o-ring and the second o-ring, and a second position wherein the piston is removed from the first o-ring and disposed within the second o-ring.

18. The piston assembly of claim 17 wherein as the piston is moved toward the second end, air passes between the first o-ring and the piston in a direction toward the first end.

19. The piston assembly of claim 17 wherein when the piston is moved from the first position to the second position, a vacuum is formed in the piston housing between the first end and the first o-ring.

* * * * *